United States Patent [19]

Tronc

[11] Patent Number: 4,975,652

[45] Date of Patent: Dec. 4, 1990

[54] LINEAR ACCELERATOR PROVIDED WITH SELF-FOCUSING CAVITIES HAVING HIGH ELECTRON CAPTURE EFFICIENCY IN RESPECT OF MODERATE INJECTION VOLTAGES

[75] Inventor: Dominique Tronc, Chatou, France

[73] Assignee: CGR MeV, Buc, France

[21] Appl. No.: 332,894

[22] Filed: Apr. 4, 1989

[30] Foreign Application Priority Data

Apr. 8, 1988 [FR] France ..... 88 04707

[51] Int. Cl.[5] ..... H05H 9/00

[52] U.S. Cl. ..... 328/233

[58] Field of Search ..... 328/233; 315/3.5, 3.6, 315/5

[56] References Cited

U.S. PATENT DOCUMENTS 3,769,599 10/1973 Leboutet et al. ..... 328/233
4,636,688 1/1987 Ito ..... 315/5 X
4,839,561 6/1989 Ito ..... 315/5 X

FOREIGN PATENT DOCUMENTS 0136216 4/1985 European Pat. Off. .
2587164 3/1987 France .

*Primary Examiner*—Sandra L. O'Shea
*Attorney, Agent, or Firm*—Oblon, Spivak, McClelland, Maier & Neustadt

[57] ABSTRACT

Good bunching and high electron capture efficiency of a first resonant cavity of an accelerator are combined with the self-focusing properties of said cavity associated with a following second cavity by modifying the law of the modulus of the electric field set up within said cavity, the amplitude of said field being greater within a first portion of the cavity than within a second portion. It is shown that the electrons are thus naturally bunched within the first portion of the cavity. In the second portion of the cavity, they are than subjected to acceleration and then to uniform focusing which includes entry into the following cavity. The result thereby achieved is to increase the capture efficiency and electron density of the beam which is accelerated from a low-voltage electron gun.

6 Claims, 2 Drawing Sheets

LINEAR ACCELERATOR PROVIDED WITH SELF-FOCUSING CAVITIES HAVING HIGH ELECTRON CAPTURE EFFICIENCY IN RESPECT OF MODERATE INJECTION VOLTAGES

BACKGROUND OF THE INVENTION

1. Field of the Invention

The present invention relates to a self-focusing cavity having high electron capture efficiency in respect of moderate injection voltages. The invention is primarily applicable to the field of linear accelerators, especially of the type employed in the field of industrial control or in the medical field in which it contributes to an improvement in reliability and efficiency of use.

2. Description of the Prior Art

A linear accelerator essentially includes an electron gun for injecting charged particles (electrons in the majority of instances), to which is connected at the downstream end an accelerating structure provided with an array of cavities in aligned relation. The cavities are supplied by a microwave power signal. When the charged particles consist of electrons, for example, the electron gun is usually made up of a cathode placed opposite to a hole anode. Under the action of the electric field produced by the high voltage applied between the cathode and the anode, electrons are detached from the cathode. They increase in velocity before arriving at the anode and escape from the electron gun through the hole of the anode. The accelerating structure placed downstream of the electron gun then has to subject these electrons to a number of effects.

The main function of this structure is to capture as many injected electrons as possible. Another function is to group them together so that, when they pass through the accelerating cavities, they undergo homogeneous modifications of their kinetic energy. Another intended function is to focus the electrons in order to impart a greater quantity of motion to a bunch of grouped electrons at the moment of an impact on a target. And finally, the structure must impart sufficient acceleration to the electrons to endow them with the necessary energy.

In order to improve the focusing, it was first considered advisable to prevent defocusing of the beam of electrons to be accelerated, at the exit of the first cavity. In fact, at the exit of the first cavity, the electrons are not yet fully accelerated and their energies are below 1 Mev even if their velocities are already close to the velocity of light. As a result, the mass of these electrons is comparable to their mass when stationary. It is said that these electrons are in that case highly mobile within the beam.

In order to avoid the divergence to which mobile electrons are subjected, it has been proposed in a French patent application No. 83 14090 filed on Sept. 2nd, 1983 by the same Applicant, to increase the length of the first cavity. In fact, the successive cavities of an accelerator which resonate with respect to each other in a $\pi$ mode, for example, have microwave electromagnetic fields which are reversed in phase in successive cavities. Thus a bunch of grouped electrons encounters a strong electric field within a cavity at the moment when, within adjacent cavities, the electric field is strong but of opposite direction. The lengths of the cavities are such that said bunch of electrons passes out of a cavity at the moment at which the electric field becomes zero at all points. This bunch of electrons then enters the following cavity at the moment when a suitable phase of the microwave signal is set up within said cavity. If necessary, drift spaces may be placed between the cavities in order to promote this phase synchronism. The electron bunch is also accelerated within the following cavity aforesaid.

In the French patent application cited above, this synchronism is upset, at least at the exit of the first cavity. From a practical standpoint, the cavities are volumes in which microwave electromagnetic fields are such that an electric field is maintained in the vicinity of the cavity axes which are followed by the electrons as they pass through these cavities. Said cavities are each provided with an entrance hole for receiving the injected particles and with an opposite exit hole through which the particles are discharged. In accordance with conventional practice, the entrance and exit holes are provided with portions which project toward the interior of the cavity. These projecting portions which surround the holes are known as cavity noses. The cavity walls are natually of metal. The lines of the electric field in the vicinity of the holes cannot be at all points parallel to the axis of the cavity between its entrance hole and its exit hole. In fact, these field lines necessarily close on the cavity noses. If the electric field at the moment when the electron bunch leaves the cavity is still very strong and generally oriented toward the following cavity (if in the final analysis the condition of synchronism is complied with or rather if the electron energy gain is optimized), these field lines are then divergent in proximity to the exit hole. Since the electrons are highly mobile at this moment, they are highly subject to this divergence effect. The beam is thus defocused.

On the other hand, if this first cavity is increased in length while the amplitudes and frequencies of the electric field are maintained at identical values, the phase of said electric field will be reversed at the actual moment of passage of the electron bunch through the exit hole or prior to this moment. In consequence, the electric field lines which result from this reversal after cancellation are then generally oriented toward the entrance of the cavity at this instant. This has the effect of slowing-down the bunch of electrons, which is objectionable. But a further effect thereby achieved (by reason of the radial component oriented in the right direction of this reversed electric field) is a radial reconcentration of the emitted electrons. It is then necessary to adjust the increase in length of the first cavity in order to ensure that the gain in focusing is not too penalizing in regard to loss of kinetic energy. It has thus been possible to determine in this patent application that the length $L_1$ of the first accelerating cavity of the linear accelerator must be such that:

$$L_1 = k'\beta\lambda_0.$$

In this formula, k' is a coefficient which is recommended as having to assume the value 0.5; $\beta$ is the ratio of the mean velocity of the electrons to the velocity of propagation of light and $\lambda_0$ is the wavelength of the microwave produced.

The disadvantage of this technique appears in regard to capture efficiency. In fact, by reason of the slowing-down process thus produced, electrons injected by the electron gun (the last injected electrons of a bunch)

arrive really too late with respect to the phase reversal of the electric field within the first cavity. In consequence, they are returned to the electron gun and are recovered by the anode. The efficiency of the accelerator therefore falls off. In order to obtain a sufficient output in spite of this difficulty, it is a tempting possibility to use an electron gun having a higher delivery. For example, the cathode of the emitting gun is heated to a higher temperature. This technique suffers from a major drawback related to the technology of cathodes. When employed under these conditions, electron guns do not have a long lifetime.

In a second French patent application No. 85 13416 filed on Sept. 10th, 1985 by the same Applicant, there was presented a device for pregrouping and acceleration of electrons in which the capture efficiency could be increased to a value in the vicinity of 100%. In its essential principle, this invention has made it possible to determine that, in order to increase the capture efficiency, it is only necessary to impose within the first cavity an electric field of sufficiently low strength to ensure that electrons coming from the electron gun are not prevented from reaching the exit of the first cavity. In practice, this entails the need to impose a value of said electric field which is lower than that imposed within the second cavity. In actual fact, the ratio of these electric fields is of the order of two. It may be stated that, at the moment of reversal of phase, the electric field at the entrance of the first cavity no longer prevents the electrons from passing through said cavity whilst the electric field at the exit of the first cavity acts as a potential barrier to be crossed by electrons which are in course of returning to the cathode (for example after reflection at the entrance of the second cavity having a more intense field). The height of the barrier is determined on the one hand by the phase of the microwave within the first cavity at the moment when the late electrons pass through the exit hole of said first cavity. This potential barrier is also intrinsically dependent in addition on the amplitude of the microwave itself. It is thus readily apparent that, by reducing the value of this amplitude, the height of said potential barrier is also reduced. It is this technique which forms the subject of the second patent application cited earlier.

Thus all the electrons pass through the potential barrier. In this case also, a compromise is determined in regard to the ratios of the amplitudes of the fields within the first and the second cavity. In the patent application in question, it is also stated that, preferably, the ratio of these amplitudes shall be within the range of 1.5 to 3 in the case of an electron gun which emits electrons with a high voltage of 80 Kv and in the case of a microwave in the S band resonating at 3 GHz. In accordance with the teachings of this patent application, it is necessary to satisfy the following relation:

$$E_1 \cdot L1 \cdot T_1 \leqq 1.5\ V_0$$

In this formula, $V_0$ is the energy of the electrons at the entrance of the first cavity (the numerical value $V_0$ expressed in eV is equal to that of the injection high voltage expressed in V), $E_1$ is the amplitude of the mean electric field within said cavity and $T_1$ is a mean transit angle factor representing the ratio between the energy really acquired by the electrons and the energy which would be acquired by these latter if the synchronism between the electric field and the electrons were complied with at all points of the cavity. It is known that the mean transit angle factor is related to the phase shift $\theta$ of the electromagnetic wave between the entrance and the exit by the following relation:

$$T_1 = \sin(\theta/2)/(\theta/2).$$

In practice, with a mean phase shift between the entrance and the exit of the first cavity of the order of $\pi$ radiant, $T_1$ has a value of approximately 0.64.

A combination of the two recommended solutions is possible in theory. It would consist in employing a first cavity of greater length than a first cavity which is normal for synchronization and in feeding this cavity so as to produce an electric field of lower strength than the field which prevails within the second cavity. From a practical standpoint, by modifying the size of the hole which provides a coupling between the first cavity and the second cavity, it is known to modify the coefficient of electromagnetic coupling between these two cavities so as to ensure that the electric field within the first cavity, which is induced by an electric field existing within the second cavity (this latter may in turn be induced by a field produced within a third cavity), is smaller than the field within the second cavity.

In practice, a combination of these two technical effects is possible only within a very high range of voltage of electron guns even in respect of a ratio of fields equal to two, for example. In the example described in the second patent application cited earlier, the electron gun voltage must have a minimum value of 80 kV. On the other hand, should it be found for particular reasons such as overall size (which finally permits a reduction in diameter of the beam) as well as cost that it is desirable to make use of electron guns having moderate voltage such as 40 kV, for example, the application of the formulae given above entails the need to ensure that the electric field to be maintained within the first cavity is limited to a low value. In one example, it has been possible to demonstrate that this electric field had to be limited to 4.5 MV/meter whereas the electric field within the second cavity was of the order of 20 MV/m.

In point of fact, when cavities are coupled with electric fields having differences of this order, the coupling is unstable. As a result, it is not possible to maintain a constant value of 4.5 MV/meter within the first cavity. The electric field fluctuates. The conditions of adjustment are difficult and unreliable.

Furthermore, the microwave electromagnetic energy stored within the first cavity is proportional to the square of the amplitude of the electric field and therefore decreases at a higher rate than this latter. The electrons of the first micro-bunches which arrive within the low-field cavity then pump the entire stored electromagnetic energy, with the result that the electrons of the last micro-bunches are no longer subjected to any field within the first volume. Under these conditions, the accelerator fails to operate.

The optimum performance which could in that case have been obtained by associating the two technical effects is no longer feasible.

The aim of the invention is to overcome these disadvantages by providing a self-focusing accelerating structure or in other words employing the self-focusing effect of the first patent application cited earlier with high electron capture efficiency while utilizing the technical effect of the second patent application cited but at moderate injection voltages. The essential idea of the invention consists in so adapting the shape of the first cavity that the electric field within said cavity is developed in a distinctly dissymmetrical manner with respect to the center of said cavity. This virtually consists in optimizing the shape of the field modulus after having determined its extension along the axis and the amplitude of its peak value.

To simplify, this first cavity has a first portion in which the field is of low strength followed at the downstream end by a second portion in which the field is of high strength. In the first portion, the electrons are moderately accelerated but are above all bunched. Since the late-arrival electrons are subjected to field phases which are generally more favorable than the electrons which arrived first, they catch up with these first electrons. At the moment of entry into the second portion of the first cavity, the electrons which are sufficiently grouped together are then accelerated over the greater part of this second portion of the first cavity. Then from the moment at which they are thus grouped together and accelerated, the electric field becomes zero and is finally reversed. Before they pass through the exit hole of said first cavity, they are then slowed-down to a slight extent (which is somewhat unfavorable) but are above all favorably self-focused by the radial component of the reversed electric field at the exit of the first cavity.

However, the dissymmetry of the field prevents any sharp deceleration and therefore any strong focusing force. Within the second cavity and possibly within a third cavity which constitute the remainder of the accelerator, the electrons then undergo known accelerating effects produced by these cavities. In addition, however, the position of the field rise within the second cavity is utilized in order to add a radially focusing effect. This was difficult in the prior art since the mean energy gain within the first cell was generally higher and resulted in more rigid bunches. The totality of the effects sought is accordingly obtained. Bunching takes place in the first portion of the first cavity, 100% capture is produced by the high accelerating field of the second portion of the first cavity which is exerted on a bunch being formed, and self-focusing is obtained by the absence of defocusing at the exit of the first cavity (and even slight focusing) combined with the intense focusing obtained at the entrance of the second cavity. It is noted that these three effects take place within two successive coupled cavities.

SUMMARY OF THE INVENTION

The object of the invention is to provide a charged-particle accelerator device comprising an electron gun for injecting particles, an array of microwave accelerating cavities located downstream of the electron gun, said array being constituted in the direction of injection at least by a first cavity and then by a second cavity, the length of the first cavity being sufficient to prevent any defocusing or even to give rise to a phenomenon of self-focusing of particles prior to their exit from said first cavity, means for ensuring that the microwave electric field developed within the first cavity is of lower strength than the microwave electric field developed within the second cavity, said charged-particle accelerator device being distinguished by the fact that it comprises means for imposing within the first cavity a law of electric field having a dissymmetrical profile with respect to a mid-plane of said first cavity, the mean value of the field within a first portion of the first cavity being lower than the mean value of the field within a second portion located downstream of said first portion of said first cavity.

DETAILED DESCRIPTION OF THE INVENTION

Figures 1, 4, 5, 6:
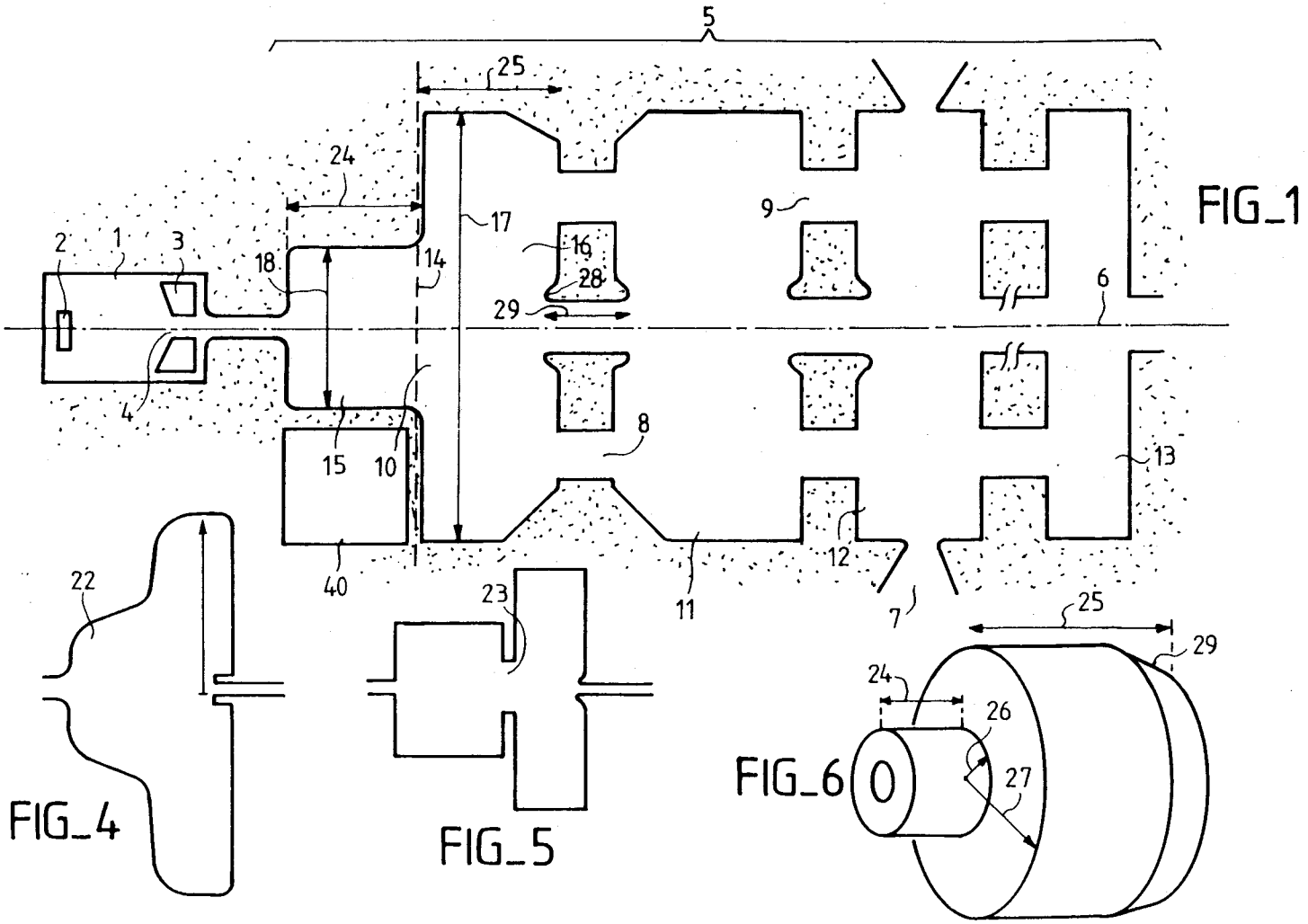
FIG. 1 illustrates a linear accelerator device in accordance with the invention.
FIGS. 4, 5 and 6 are schematic diagrams in perspective showing examples of construction of the first cavity of the device of FIG. 1.

FIG. 1 illustrates a charged-particle accelerator device in accordance with the invention. In this case, the charged particles are essentially electrons produced by an electron gun 1 having an emissive cathode 2 and a hollow anode 3 provided with a hole 4 through which the emitted electrons can be injected into an array 5 of accelerating cells located downstream. The array 5 is provided in the direction of injection and in alignment along an axis 6 of acceleration with a certain number of microwave accelerating cavities. The cavities are located downstream of the electron gun and subjected to a microwave emectromagnetic field produced by a source (not shown) applied for example by a coupling 7 of radial type within one of the cavities. The cavities can be supplied with microwave electromagnetic energy by coupling between the cavities by means of irises such as 8 and 9. In particular, this coupling can be magnetic. By way of example, these irises are located respectively between a first cavity 10 and a second cavity 11, and between said second cavity 11 and a third cavity 12. The cavity 12 receives the microwave energy. Other cavities such as 13 can be placed in the downstream direction: their number and function depend on the energy required for the beam of accelerated particles at the exit of the accelerator.

As stated earlier, the first cavity 10 is of slightly greater length than the normal length which it should have if all the electrons were required to pass through said cavity prior to reversal of phase of the microwave field which prevails within said cavity 10. By way of example, the length of said cavity is of the same order as that mentioned in the first patent application cited earlier. There then takes place at the exit of said first cavity a refocusing of electrons about the axis 6. Moreover, the iris 8 is so dimensioned that the amplitude of the microwave electric field which prevails within the cavity 10 even where the field is strongest is smaller than the amplitude of the electric field which prevails within the cavity 11. In practice, as stated earlier, the ratio between these two fields is of the order of two. By computing the cross-sectional area of the iris 8, it is known to impose predetermined amplitude ratios.

In accordance with the invention, the first cavity is essentially provided with means whereby the modulus of the electric field within said first cavity is not symmetrical with respect to a mid-plane 14 of said cavity. For example, a mid-plane 14 divides the cavity 10 lengthwise into two portions of substantially equal length. In practice, the cavity accordingly has two portions, namely a first portion located on the left and a second portion located on the right of said mid-plane. The left portion 15 is of smaller size than the right portion 16. When it has the shape of a circular cylinder, the downstream portion 16 has a diameter 17 such as to permit resonance in a $TM_{O1}$ mode of the microwave electromagnetic field within said cavity. On the other hand, the left portion 15 has a smaller diameter 18 which may be one-half of the diameter 17, for example, in order to damp said resonance. Said portion 15 constitutes a cutoff waveguide for the resonance mode established within the second portion 16. In consequence, the electric field within the first portion 15 is of lower strength.

Figure 2:
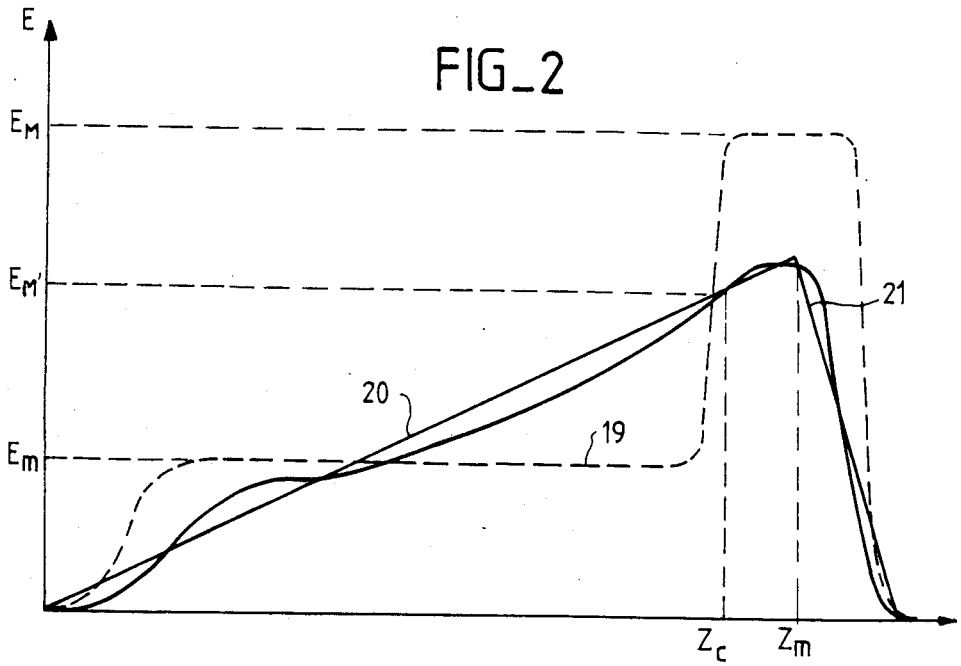
FIG. 2 represents real and ideal electric field distributions for effective implementation of the invention.

FIG. 2 serves to gain an understanding of the physical phenomenon utilized in the present invention. There are shown in this figure the amplitudes E of the electric fields developed within the first cavity 10 as a function of the abscissa of a point within said cavity as measured along the axis 6. On an ideal theoretical curve 19 represented by a dashed line, the electric field exhibits two plateaus in which the amplitude has the respective values $E_m$ and $E_M$. The electrons injected by the gun first encounter the region 15 of the cavity 10 in which the electric field has the value $E_m$. This makes it possible to bunch the electrons longitudinally without stopping them. In particular, the electrons which arrive first can be slightly slowed-down whereas the electrons which arrive last are slightly accelerated so as to group these electrons together and thus to form bunches. Bunching is facilitated by the very moderate energy of the entering electrons. This is conducive to the same result as the advantage sought for the invention which consists in making use of electron guns having a low injection voltage.

In fact, since all electrons travel at low velocities, it is clearly easier to produce substantial differences in velocity between said electrons so as to obtain the desired bunching effect.

The result thereby achieved is that all these electrons are sufficiently grouped together or bunched at the moment of entry into the second portion 16 of the cavity 10. A strong electric field is maintained within said second portion and the electrons are therefore highly accelerated therein. It is of interest to note that, under these conditions, they are highly accelerated but in a uniform manner by reason of their preliminary bunching. Before the electrons have passed through the exit of the cavity 10, the phase of the field becomes zero and can even be reversed. During a very short instant, the electrons are no longer accelerated and can even be slowed-down while they are being refocused. The technical effect described in the first patent application cited earlier is thus utilized. However, making due allowances for the moderate value of electric field within the second portion of the first cavity, these electrons have been sufficiently accelerated during their passage through said second portion to cross the potential barrier constituted by the phase reversal.

Said electrons then terminate within the second cavity 11 located downstream in which the acceleration phenomenon proper is carried into effect by virtue of the large amplitude of the electric field developed within said second cavity. In practice, the mean accelerating electric field developed within the second cavity is of the order of 20 Mv/m, is of the order of 10 Mv/m within the second portion of the first cavity, and is of the order of 5 Mv/m within the first portion of the first cavity. The description of the invention as given with reference to coupling in the $\pi$ mode does not exclude the possibility of applying this invention to a different coupling mode with the customary transpositions.

In fact, these values $E_m$ and $E_M$ correspond to ideal theoretical values which are far from being achievable in practice. The cutoff waveguide design as indicated earlier does not actually make it possible to have an electric field distribution in two plateaus. Such a design makes it possible to have only a relatively uniform progression of the electric field modulus as a function of the abscissa along the axis 6. Nevertheless, with respect to the mid-plane 14, it is very clear that the electric field has a dissymmetry. Thus the portion located on the left has a mean value $E_m$ whilst the portion located on the right is subjected to an electric field having a mean value $E_M'$. And the expected technical effects occur but are not totally differentiated. It is understood that bunching is more particularly facilitated within the first portion whereas acceleration is more particularly facilitated within the second portion. For example, the real curve of the field oscillates slightly about a contour represented by a triangle having a relatively slow upward ramp 20 and a sharp falloff portion 21 near the exit of the cavity 10.

The advantage of a plateau having a constant value $E_M$ with respect to a ramp 20 lies in the amplitude of the radial component of the electric field within a critical zone of abscissa $Z_c$. This zone is a critical zone insofar as it corresponds to the critical point of the cavity at which certain electrons have minimum values of kinetic energy. In fact, the radial (defocusing) component of the field is proportional to the derivative (along the abscissa on the axis 6) of the electric field. The less said electric field varies (the flatter the field), the less it is defocusing.

In practice, steps must be taken to ensure that the first portion (namely the portion in which the field is weaker) is at least as long as that in which the field is stronger. It is also sought to obtain a concave shape of the law of modulus of the field along the axis, thereby making it possible to associate an appreciable premodulation from the beginning of the cavity with a moderate variation in amplitude in the vicinity of $Z_c$.

A modification of the shape of the cavity 1 in order to add the recess 15 thereto may entail the need to modify the resonance frequency of said cavity. Said constant frequency is maintained by slightly increasing the radius 17 with respect to the value which it should normally have if this cavity were of a conventional type. The inductance is thus increased by compensating the reduction in capacitance related to the addition of the recess constituted by the portion 15.

In the absence of any additional magnetic field applied externally for focusing the electrons, there is noted an imperfect control of certain so-called critical electrons. This imperfect control has the effect of producing a radial divergence. This may be remedied by finer optimization of the geometry of the first cavity and by applying a light focusing magnetic field. The strong influence even of a light magnetic field can more readily be understood by analyzing the motion of a highly slowed-down or even stationary critical electron which departs in the reverse direction and is then again stopped so as to start-off again in the forward direction: this is the case of a longitudinal oscillation.

Figure 3:
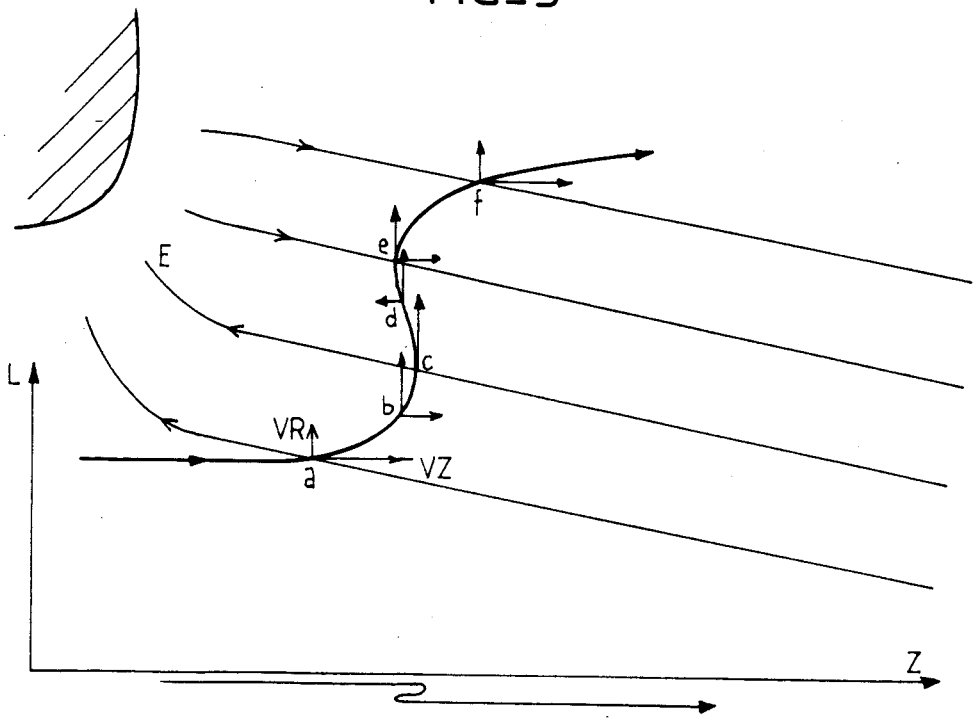
FIG. 3 represents the path of critical electrons within the first cavity.

FIG. 3 represents a longitudinal oscillation of this type and shows the analysis of motion of a critical electron (one of the first arrivals within the first portion of the first cavity). In this diagram, the velocities have been resolved into their longitudinal and radial components at different points of the electron path. The electric field E is also represented by taking into account its time variation: first, slowing-down and defocusing, then accelerating and focusing. The particle is stopped twice longitudinally and has a radial velocity which is unfavorable practically all the time, thus resulting in a considerable distance of displacement from the axis. However, the addition even of a low magnetic field causes the electrons to rotate azimuthally, thus permitting radial control. The longitudinally oriented constant magnetic field can then be applied by any known means in the present state of the technique. It is possible in particular to incorporate a circular magnet 40 as shown only partially in FIG. 1.

FIGS. 4 and 5 are schematic sectional views showing alternative embodiments of the first cavity. In FIG. 4. the left-hand portion of the cavity is clearly seen to be a recess 22 formed in a conventional cavity. The diameter of said conventional cavity must be slightly increased in order to obtain the same resonance frequency as that of the injected microwave. In FIG. 5, the left-hand portion of the cavity 10 not only has a smaller cross-sectional area than the right-hand portion (as measured at right angles to the axis 6) but is even separated from this latter by a coupling hole 23. Said coupling hole must be formed so as to produce no phase drift between the continuous waves within the two portions of the cavity. In this case, FIG. 5 clearly shows a single cavity and not two coupled cavities such as those described in the patent applications cited earlier.

The perspective view of FIG. 6 shows the preferred shape of the cavity which is illustrated in FIG. 1. In this case, there is no coupling hole 23. The upstream and downstream portions of said first cavity each have a length 24 and 25 which are substantially equal to each other. The radius 26 of the left-hand portion has one-half the value of the radius 27 of the right-hand portion. The presence of a cavity nose 28 (FIG. 1) at the exit of this first cavity has an effect somewhat similar to a tip effect in that it produces a concentration of the electric field lines which are directed onto said nose. This also has a general focusing effect.

By reason of the general increase in the shape of the electric field within the first cavity as considered along the axis 6, this results in the defocusing effect mentioned above. Self-focusing can be produced by allowing the electrons to leave only after the electric field has reversed so as to have a slowing-down and focusing action. It is possible in particular to increase the convergence effect by allowing these electrons to enter the following cavity 11 only when the field within said cavity is highly convergent. In practice, it is necessary to wait until the phase of said field within the cavity 11 has taken a slight lead in order to ensure that the instantaneous amplitude of said field is then significant. To this end, the first cavity 10 is coupled to the second cavity 11 by means of a drift space 29, the length of which is sufficient to delay entry of the electron bunch with respect to the phase variation of the microwave signal within the second cavity.

In practice, the length of the drift space 29 must ensure that the accelerating amplitude at the entrance of the second cavity is greater than one-half the maximum amplitude. The result thereby achieved is that the space 29 has a value substantially of one-eighth of the wavelength simply if any defocusing radial component has been cancelled when the beam emerges from the first cavity. This value is wholly reasonable and well suited for the thicknesses of irises and noses which are employed in practice.

The practical application of the invention has thus made it possible to obtain capture efficiencies of the order of 75% with electron guns of 40 kV while at the same time improving the radial control with respect to designs of the prior art. The beam cross-section current densities obtained have been increased by a factor which is estimated at five.

What is claimed is:

1. A charged-particle accelerator device comprising an electron gun for injecting particles, an array of microwave accelerating cavities located downstream of the electron gun, said array being constituted in the direction of injection at least by a first cavity and then by a second cavity, the length of the first cavity being sufficient to either prevent any defocusing or to give rise to a phenomenon of self-focusing of particles prior to their exit from said first cavity, means for ensuring that the microwave electric field developed within the first cavity is of lower strength than the microwave electric field developed within the second cavity, wherein said charged-particle accelerator device further comprises means for imposing, within the first cavity, a law of electric field, said law of electric field having a dissymmetrical profile with respect to a mid-plane of said first cavity, the mean value of the field within a first portion of the first cavity being lower than the mean value of the field within a second portion located downstream of said first portion of said first cavity.

2. A device according to claim 1, wherein the length of the first portion is greater than the length of the second portion.

3. A device according to claim 1, wherein the cross-sectional area of the first cavity within the first portion is smaller than the cross-sectional area of the cavity within the second portion.

4. A device according to claim 1, wherein the first portion constitutes a cutoff waveguide for a mode of resonance of the field within the second portion.

5. A device according to claim 1, wherein the two cavities are separated by a drift space of greater length than one-eighth of the wavelength so as to benefit by self-focusing of the field at the entrance of the second cavity in the $\pi$ coupling mode.

6. A device according to claim 1, wherein the first cavity is further provided with magnetic focusing means acting as said means to ensure.

* * * * *